US006316122B1

(12) United States Patent
Amamoto

(10) Patent No.: US 6,316,122 B1
(45) Date of Patent: Nov. 13, 2001

(54) TITANIUM FIBER AND METHOD OF PRODUCING THE SAME

(75) Inventor: Shuji Amamoto, Kuroiso (JP)

(73) Assignee: Bridgestone Metalpha Corporation, Tokyo (JP)

( * ) Notice: Subject to any disclaimer, the term of this patent is extended or adjusted under 35 U.S.C. 154(b) by 0 days.

(21) Appl. No.: 09/144,346

(22) Filed: Aug. 31, 1998

(30) Foreign Application Priority Data

Sep. 1, 1997 (JP) ..... 9-251322

(51) Int. Cl.[7] ..... B21C 1/00; B21C 37/00

(52) U.S. Cl. ..... 428/606; 29/527.1; 72/274; 228/126; 148/516; 148/530; 148/534; 148/670; 148/421; 428/607; 428/612; 428/660; 428/683; 428/687; 428/903; 428/926

(58) Field of Search ..... 420/417; 428/606, 428/607, 612, 660, 683, 687, 903, 926; 148/516, 530, 534, 670, 421; 29/527.1; 72/274; 228/126

(56) References Cited

FOREIGN PATENT DOCUMENTS

WO 97/04152 * 2/1997 (BE) .
2-187212-A * 7/1990 (JP) ..... B21C/1/00
5-177244-A * 7/1993 (JP) ..... B21C/1/00

OTHER PUBLICATIONS

Patent Abstracts of Japan, vol. 017, No. 592 (JP 05–177244), Oct. 28, 1993.

Patent Abstracts of Japan, vol. 014, No. 231 (JP 02–059109), Feb. 28, 1990.

DataBase WPI, Section Ch, Week 9035, Derwent Publications Ltd., XP002104395 (JP 02–187212A), Jul. 23, 1990.

DataBase WPI, Section Ch, Week 9040, Derwent Publications Ltd., XP002104396 (JP 02–211901A), Aug. 23, 1990.

* cited by examiner

*Primary Examiner*—Robert R. Koehler
(74) *Attorney, Agent, or Firm*—Sughrue, Mion, Zinn, Macpeak & Seas, PLLC

(57) ABSTRACT

A metal fiber of titanium or titanium alloy has given equivalent area diameter and specific surface area and is produced by a bundle drawing method wherein mild steel is used as a material for covering layer and outer housing and a composite wire is subjected to a heat treatment at a given temperature.

5 Claims, 2 Drawing Sheets

TITANIUM FIBER AND METHOD OF PRODUCING THE SAME

BACKGROUND OF THE INVENTION

1. Field of the Invention

This invention relates to a titanium fiber or a titanium alloy fiber having an equivalent area diameter of 5–30 μm and a method of producing the same, and more particularly to a titanium fiber or titanium alloy fiber having a large specific surface area and a method of producing the same.

Throughout the specification, the titanium and titanium alloy are generically called as "titanium".

2. Description of Related Art

Extrafine metal fibers having a diameter of about 5–30 μm are used in various fields such as a material for a filter or a catalyst carrier, or as a filler for giving an electric conductivity or a strength to plastics, cloth and the like. As the extrafine metal fiber, there are widely used stainless fibers produced by a bundle-drawing method. On the other hand, it is demanded to develop a material for the filter or catalyst carrier having a corrosion resistance higher than that of the stainless fiber, or a filler having a light weight and a high strength as compared with those of the stainless fiber, and hence titanium fibers are recently noticed. Particularly, the titanium fibers having a larger specific surface area are demanded in the catalyst field requiring a surface area participant in the reaction as an important factor.

In the production of the extrafine metal fiber having a diameter of about 5–30 μm, there is known a bundle-drawing method as follows.

For example, JP-A-2-52117 discloses a method wherein a bundle-drawn composite body (composite filament) having an outer housing of steel and containing metal fibers embedded in copper matrix is prepared, and then the outer housing of steel and the copper matrix (covering layer) are removed by substitution reaction and electrolysis to obtain a bundle of metal fibers. However, this method is not suitable for the production of titanium fibers having a large specific surface area because the titanium fiber obtained by this method is small in the surface unevenness, so that in order to obtain titanium fibers having a large specific surface area, the fiber size should be made finer and hence labor and cost required for the working undesirably increase.

And also, JP-A-5-177244 discloses a method wherein a covered wire consisting of a core wire of high corrosion-resistant alloy with a covering layer of steel having a carbon content of not more than 0.12% by weight is subjected to cold drawing to form a covered filament, and a plurality of the covered filaments are bundled and inserted into an inside of a steel tube to form a composite wire, and the composite wire is subjected to cold drawing to form a composite filament, and then the steel tube and portion corresponding to the coated layer are dissolved out by electrolysis to obtain a bundle of metal fibers. However, when this method is applied to the production of titanium fibers, it implies a problem of insufficient dissolution in the final step causing low yield of titanium fibers though the surface unevenness becomes can be made large as compared with the case of JP-A-2-52117.

SUMMARY OF THE INVENTION

It is, therefore, an object of the invention to solve the afore-mentioned problems of the conventional techniques and to provide a titanium fiber having a specific surface area larger than that of the conventional titanium fiber having the same fiber size and a method of surely producing the same in a high efficiency.

According to a first aspect of the invention, there is the provision of a metal fiber made of titanium or titanium alloy by a bundle drawing method and having an equivalent area diameter d of 5–30 μm and a specific surface area A ($m^2/g$) satisfying $A \geqq 25/d$, preferably $30/d \leqq A \leqq 50/d$.

According to a second aspect of the invention, there is the provision of a method of producing a bundle of metal fibers made of titanium or titanium alloy, which comprises the steps of:

covering a bundle of covered filaments, each consisting of a core wire made of titanium or titanium alloy and a covering layer formed around the core wire with an outer housing to form a composite wire;

subjecting the composite wire to repetition of cold drawing and heat treatment to form a composite filament containing fibers of a given size; and removing portions of the composite filament corresponding to the covering layer and the outer housing to obtain a bundle of metal fibers made of titanium or titanium alloy, wherein material of each of the covering layer and the outer housing is a mild steel containing not more than 0.25% by weight of carbon, and maximum temperature of the composite wire reached in the heat treatment is within a range of 580–650° C.

In a preferable embodiment of the second aspect of the invention, the production of the covered filaments comprises a step of forming a covering layer around a core wire to form a covered wire and a step of subjecting the covered wire to heat treatment and cold drawing at least one time to form a covered filament having a given diameter, in which maximum temperature of the covered wire reached in the heat treatment is within a range of 580–650° C. In another embodiment of the invention, a thickness of the covering layer in the covered filament is 5–20% of a diameter of the covered filament. In the other embodiment of the invention, total amount of the cold drawing applied to the composite wire defined by $\epsilon_T = 2 \times \ln(D_S/D_F)$ is within a range of 5.5–7.5 (wherein $D_S$ is a diameter of the composite wire before the cold drawing and $D_F$ is a diameter of the composite filament).

BRIEF DESCRIPTION OF THE DRAWINGS

The invention will be described with reference to the accompanying drawings, wherein.

DESCRIPTION OF PREFERRED EMBODIMENTS

The metal fiber made of titanium or titanium alloy according to the invention has an equivalent area diameter d of 5–30 μm obtained by the bundle-drawing method and a specific surface area A ($m^2/g$) of $A \geqq 25/d$, preferably $30/d \leqq A \leqq 50/d$. The term "equivalent area diameter" used herein means a diameter of a circle having the area as that of a cross section of the fiber.

The value of the specific surface area defined in the invention is high as compared with that obtained by the conventional production method and is about 2 times or more as compared with that of the usually used stainless fiber provided that the equivalent area diameter is the same. Therefore, when the metal fiber according to the invention is used as a catalyst carrier, a gas adsorbent or the like, there can be expected remarkable weight reduction.

The preferred range for the specific surface area is set based on the following reasons. When the specific surface area A ($m^2/g$) satisfies A=30/d, a remarkable improvement can be achieved over the conventional titanium fiber having the same diameter d ($\mu$m). On the other hand, the upper limit of the preferred range of A is set to prevent the degradation of productivity caused by intense irregularity of the fiber surface necessary to obtain the specific surface area A ($m^2/g$) exceeding 50/d. That is, when the specific surface area exceeds the upper limit, the intense irregularities between adjoining metal fibers in the composite filament are entangled with each other and hence it is difficult to separate these metal fibers from each other at the removal step of the covering layer and the outer housing.

In order to provide the specific surface area satisfying A≧25/d, it is necessary that fine irregularities are formed on the surface of the metal fiber to increase the surface area. Although the surface area can be increased by flattening or curving the sectional form of the metal fiber, the following is preferable. That is, the outer sectional contour of the metal fiber is rendered into an approximately circular form, an approximately ellipsoidal form, an approximately convex polygonal form or the like, and fine irregularities are formed on the surface of the metal fiber having such a sectional form to increase the surface area. In this way, the specific surface area can be increased without damaging the processability and strength which are required in the processing of such metal fibers into a thread, a woven fabric, a felt or the like.

Figure 2:
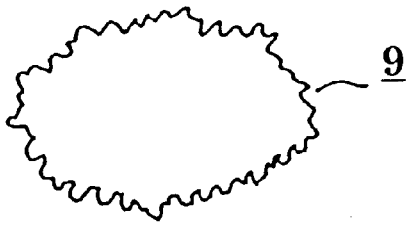
FIG. 2 is a diagrammatic view illustrating a sectional surface of the titanium fiber according to the invention.

In FIG. 2 is schematically shown an embodiment of the sectional form of the titanium fiber according to the invention. The titanium fiber 9 shown in FIG. 2 is ellipsoidal in the outer sectional contour and has many fine irregularities on its surface. Moreover, the specific area of the surface including the fine irregularities can be determined, for example, by measuring a gas adsorbed surface area according to BET method.

As a material for the titanium fiber according to the invention, use may be made of pure titanium, α alloys, α-β alloys and β alloys as shown in Table 1 extracted from Processing Technique of Titanium edited by The Titanium Society of Japan. In Table 1, heat treatment conditions for titanium according to the MIL standard are also shown.

TABLE 1

| Type | Alloy | temperature | |
|---|---|---|---|
| α alloy | pure titanium | 538~816 | 0.03~2 followed by air cooling or slow cooling |
| | Ti—5Al—2.5Sn | 704~913 | 0.03~4 followed by air cooling or slow cooling |
| α-β alloy | Ti—3A1—2.5V | 704~760 | 1~3 followed by air cooling |
| | Ti—6Al—2Cb—1Ta—1Mo | 704~927 | 0.03~4 followed by air cooling |
| | Ti—8Al—1Mo—1V | 704~927 | 0.03~8 followed by air cooling |
| | Ti—6Al—2Si—4Zr—2Mo | 704~843 | 1~3 followed by air cooling |
| | Ti—6Al—4V | 690~871 | 0.03~8 followed by air cooling |
| | Ti—6Al—6V—2Sn | 704~816 | 1~3 followed by air cooling |
| β alloy | Ti—13V—11Cr—3Al | 760~816 | 0.03~1 |

Figure 1:
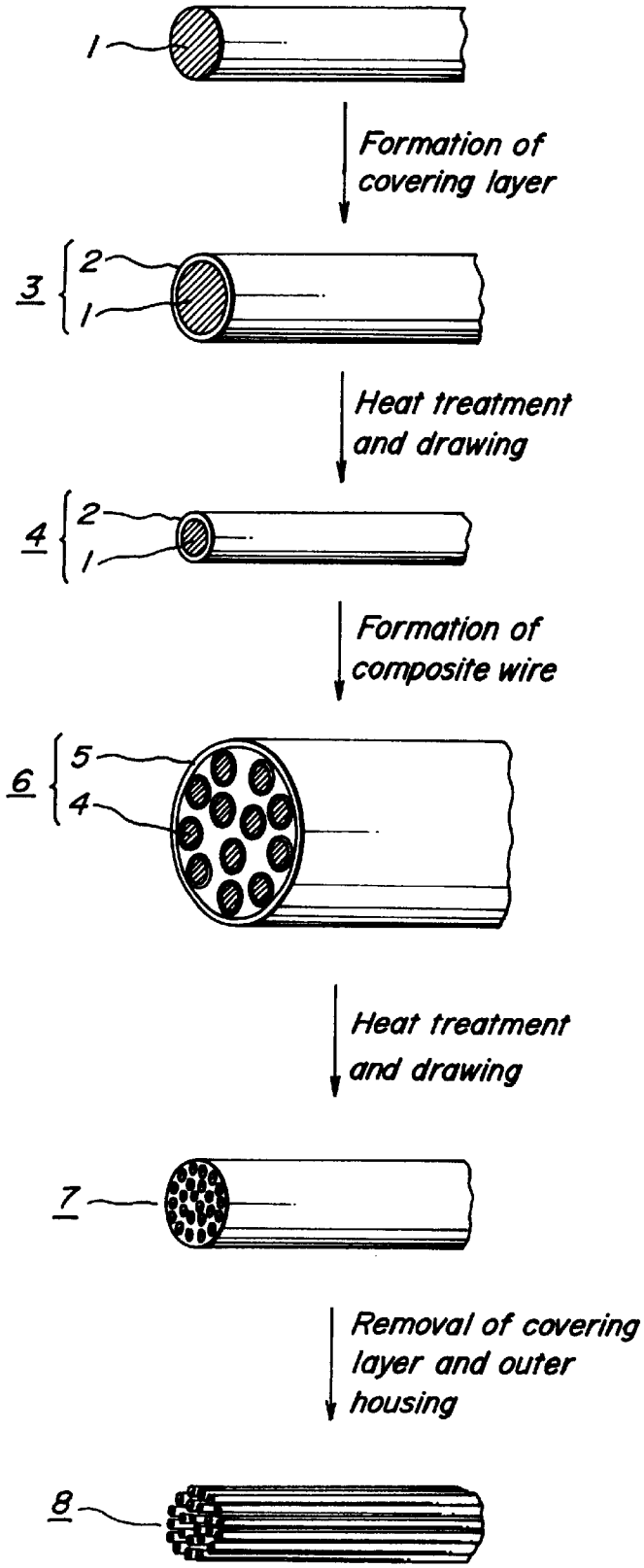
FIG. 1 is a flow chart illustrating steps of producing titanium fiber according to the invention.

An embodiment of the production of the titanium fiber according to the invention will be described with reference to FIG. 1 below.

The method of producing the titanium fiber according to the invention is concerned with a method of producing titanium fibers by a bundle drawing method, which comprises a step of covering a bundle of covered filaments 4 each consisting of a core wire 1 and a covering layer 2 formed therearound with an outer housing 5 to form a composite wire 6, a step of subjecting the composite wire 6 to repetition of cold drawing and heat treatment to form a composite filament 7, and a step of removing portions of the composite filament 7 corresponding to the covering layer 2 and the outer housing 5 to obtain a bundle 8 of metal fibers and has the following features:

(a) The core wire 1 is a titanium wire or titanium alloy wire.

As the material of the core wire, there are used pure titanium, α alloys, α-β alloys and β alloys as shown in Table 1.

(b) Each of the covering layer 2 for the covered filament 4 and the outer housing 5 for the composite wire 6 is a mild steel containing not more than 0.25% by weight of carbon.

(c) The maximum arrival temperature of the composite wire 6 in the heat treatment applied to the composite wire is 580–650° C.

Particularly, the material of the covering layer 2 for the covered filament 4 is important for facilitating the set of heat treating conditions as mentioned later. Further, it is favorable that the outer housing 5 for the composite wire 6 is the same material as the covering layer 2 for the covered filament 4.

Figure 4:
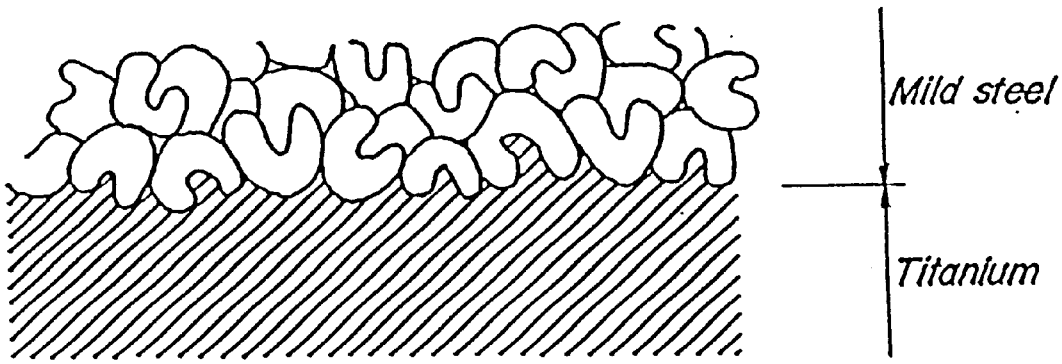
FIG. 4 is a diagrammatic view illustrating a state of the vicinity of a boundary between mild steel and titanium at section of a composite filament produced in the invention.

Another aim in particularly specifying the material of the covering layer 2 is to form many irregularities on the surface of the titanium fiber 8 to be produced to increase the specific surface area. That is, the mild steel is a polycrystalline material having a crystal structure of body-centered cubic lattice in which individual crystal grains have a strong anisotropy to deformation Therefore, when the composite wire 6 formed by covering a bundle of the covered filaments 4 each consisting of titanium as the core wire 1 and mild steel as the covering layer 2 with the outer housing 5 is subject to drawing, individual crystal grains of the mild steel constituting the covering layer 2 are curved and deformed in lateral section as diagrammatically shown in FIG. 4, wherein many irregularities are formed on the surface of the titanium core wire 1 to thereby increase the specific surface area of the titanium fiber 9 obtained by removing the portions corresponding to the covering layer 2 and the outer housing 5.

Figure 3:
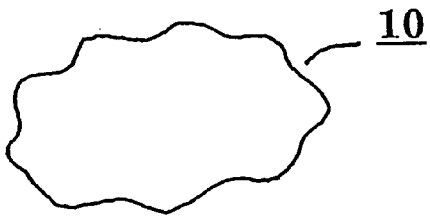
FIG. 3 is a diagrammatic view illustrating a sectional surface of a titanium fiber obtained according to the conventional technique.

On the other hand, when a crystal material such as copper or the like having a crystal structure of face-centered cubic lattice is used as the covering layer 2, crystal grains of such a crystal material are substantially isotopically deformed in the drawing, so that the formation of the irregularities is insufficient as compared with the case of using mild steel as a covering layer and the resulting metal fiber 10 has undesirably a section as diagrammatically shown in FIG. 3.

In the production of the titanium fiber according to the invention, mild steel containing not more than 0.25% by weight, preferably not more than 0.12% by weight of carbon is favorable among polycrystalline materials having a body-centered cubic lattice as a material of the covering layer 2 because it is low in the material cost and good in the processability and facilitates the formation of the covered filament 4. When the carbon content exceeds 0.25% by weight, the hardening degree through the drawing is large and it is undesirably required to increase the heat treatment number in the course of the drawing and also it is difficult to sufficiently restore the wire drawability in such a heat treatment that the maximum arrival temperature is 580–650° C. When it is not more than 0.25% by weight, preferably not more than 0.12% by weight, the above problems can be solved. And also, the covering layer can be easily formed by an electroseamed pipe using mild steel strip having such a low carbon content which is excellent in ductility and weldability. In contrast, when a carbon steel having, for example, a carbon content of about 0.55% by weight is used as a covering layer formed by an electroseamed pipe, a portion welded in the formation of the electroseamed pipe is cracked in the drawing and does not withstand on the way of the drawing.

As a material for the covering layer 2, a standard mild steel strip such as SPCC or SPCE can be used. Here, SPCC and SPCE are standard mild steel sheets or strips according to the Japanese Industrial Standard for cold rolled carbon steel sheets and strips. In order to deepen the depth of the irregularity in the surface of the titanium fiber 8 to be produced to obtain titanium fibers having a larger specific surface area, it is favorable that the thickness of the mild steel covering layer 2 becomes relatively thicker to the diameter of the covered filament 4. However, when the thickness is too thick, it is liable to cause a problem that a time required at the removal step of the covering layer 2 and the outer housing 5 becomes longer. Therefore, the thickness of the covering layer 2 is favorable within a range of 5–20%, preferably 8–15% of the diameter of the covered filament 4.

As the amount of cold drawing applied to the composite wire 6 formed by covering the bundle of the covered filaments 4 with the outer housing 5 becomes large, the curving degree of individual crystal grains in mild steel becomes large to obtain titanium fibers having a large specific surface area, but there is caused a problem that the long time required at the removal step is taken. Therefore, it is favorable that the total amount $\epsilon_T$ of cold drawing applied to the composite wire ($\epsilon_T=2\times\ln(D_S/D_F)$) is within a range of 5.5–7.5, wherein $D_S$ is a diameter of the composite wire 6 before the cold drawing and $D_F$ is a diameter of the composite filament 7.

When $\epsilon_T$ is less than 5.5, the curving degree of the crystal grains in mild steel is small and hence the irregularity of the titanium fiber is small and the specific surface area is not so large. When it exceeds 7.5, the irregularity on the surface of the titanium fiber is violent and hence the adjoining titanium fibers in the composite filament mechanically entangles with each other and it is difficult to separate the titanium fibers from each other at the removal step.

The limitation of temperature range concerning the heat treatment of the composite wire is set after the inventors have made various experiments and studies with respect to the conditions of the heat treatment applied to the composite wire 6 formed by covering the bundle of the covered filaments 4 each consisting of titanium core wire 1 and mild steel covering layer 2 with the outer housing 5 of mild steel.

Although the standard heat treatment conditions to titanium not covered with mild steel are previously shown in Table 1, when the composite wire 6 comprising the covered filaments 4 obtained by forming the mild steel covering layer 2 around the titanium core wire 1 is subjected to the heat treatment, it has been confirmed that it is necessary to consider diffusion phenomenon at an interface between titanium and mild steel together with the softening degree of the composite wire 6. That is, when the maximum arrival temperature exceeds 650° C., an alloy formed through the diffusion at the interface between titanium and mild steel grows and hence the removal of the covering layer 2 is difficult if it is intended to obtain titanium fibers 8 by removing the covering layer 2, or even if the titanium fibers 8 are obtained, titanium fibers are obtained from only a part of the composite filament 7 and hence the yield considerably lowers. While, when the maximum arrival temperature is lower than 580° C., the softening degree of the composite wire 6 is insufficient and hence it is apt to considerably cause the breaking of the wire in the cold drawing.

Thus, the maximum arrival temperature in the heat treatment at least applied to the composite wire 6 is required to be 580–650° C. in the production of the titanium fiber according to the invention. If the step of forming the covered filament 4 before the formation of the composite wire 6 includes the heat treatment to the covered wire 3 before the application of the outer housing 5 (i.e. before the bundling of the covered filaments 4), it is favorable that the maximum arrival temperature in the heat treatment applied to the covered wire 3 is also within a range of 580–650° C. Moreover, when the composite wire 6 or the covered wire 3 is subjected to the heat treatment, since titanium being active in its surface is covered with mild steel, the heat treatment can be carried out in an atmosphere conventionally applied to heat treatments of steel wires. And also, the conventional heating furnace such as a gas combustion furnace, an electric furnace or the like can be used as a beating means for the heat treatment.

In the production of the titanium fiber according to the invention, the reason why the composite wire 6 is subjected to the cold drawing is due to the fact that if the composite wire is subjected to hot drawing at a high temperature, the anisotropy to the working is mitigated to lower the effect of forming the irregularities on the surface of titanium fiber and also it is easy to grow the alloyed layer at the interface between titanium and mild steel. As the cold drawing, there may be applied dry or wet drawing using hole dies, roller dies and the like. And also, since the surface of the composite wire 6 or the covered filament 4 is covered with mild steel, the drawing may be carried out by using a lubricant for the drawing of steel wire.

The following examples are given in illustration of the invention and are not intended as limitations thereof.

The production of the composite filament 7 including many titanium fibers are attempted under five kinds of production conditions shown in Table 2, during which the stability in the production steps, yield of titanium fibers in the removal step, and properties of titanium fiber 8 produced through the removal step are measured.

TABLE 2(a)

| Step | Operation | Item | Example 1 | Example 2 | Comparative Example 1 | Comparative Example 2 | Comparative Example 3 |
|---|---|---|---|---|---|---|---|
| Production of covered filament | formation of covering layer | core material | pure titanium wire | pure titanium wire | pure titanium wire | pure titanium wire | pure titanium wire |
| | | material of covering layer | mild steel | mild steel | mild steel | mild steel | copper |
| | | thickness of covering layer | 0.4 mm | 0.6 mm | 0.4 mm | 0.4 mm | 0.4 mm |
| | | diameter of covered filament | 4.3 mm | 4.3 mm | 4.3 mm | 4.3 mm | 4.3 mm |
| | heat treatment | furnace temperature | 620° C. | 620° C. | 620° C. | 620° C. | 800° C. |
| | | time passing through furnace | 90 sec. | 90 sec. | 90 sec. | 90 sec. | 90 sec. |
| | | arrival temperature | 620° C. | 620° C. | 620° C. | 620° C. | 800° C. |
| | dry drawing | diameter before drawing | 4.3 mm | 4.3 mm | 4.3 mm | 4.3 mm | 4.3 mm |
| | | diameter after drawing | 1.19 mm | 1.19 mm | 1.19 mm | 1.19 mm | 1.19 mm |
| | heat treatment | furnace temperature | 620° C. | 620° C. | 620° C. | 620° C. | 800° C. |
| | | time passing through furnace | 40 sec. | 40 sec. | 40 sec. | 40 sec. | 40 sec. |
| | | arrival temperature | 620° C. | 620° C. | 620° C. | 620° C. | 800° C. |
| | wet drawing | diameter before drawing | 1.19 mm | 1.19 mm | 1.19 mm | 1.19 mm | 1.19 mm |
| | | diameter after drawing | 0.18 mm | 0.18 mm | 0.18 mm | 0.18 mm | 0.18 mm |

TABLE 2(b)

| Step | Operation | Item | Example 1 | Example 2 | Comparative Example 1 | Comparative Example 2 | Comparative Example 3 |
|---|---|---|---|---|---|---|---|
| Production of composite filament | formation of composite wire | number of covered filaments | 250 | 250 | 250 | 250 | 250 |
| | | material of outer housing | mild steel | mild steel | mild steel | mild steel | mild steel |
| | | thickness of outer housing | 0.4 mm | 0.4 mm | 0.4 mm | 0.4 mm | 0.4 mm |
| | | diameter of composite wire | 4.3 mm | 4.3 mm | 4.3 mm | 4.3 mm | 4.3 mm |
| | heat treatment | furnace temperature | 620° C. | 620° C. | 550° C. | 700° C. | 720° C. |
| | | time passing through furnace | 90 sec. | 90 sec. | 90 sec. | 90 sec. | 90 sec. |
| | | arrival temperature | 620° C. | 620° C. | 550° C. | 700° C. | 720° C. |
| | dry drawing | diameter before drawing | 4.3 mm | 4.3 mm | 4.3 mm | 4.3 mm | 4.3 mm |
| | | diameter after drawing | 1.19 mm | 1.19 mm | 1.19 mm | 1.19 mm | 1.19 mm |
| | heat treatment | furnace temperature | 620° C. | 620° C. | 550° C. | 700° C. | 720° C. |
| | | time passing through furnace | 40 sec. | 40 sec. | 40 sec. | 40 sec. | 40 sec. |
| | | arrival temperature | 620° C. | 620° C. | 550° C. | 700° C. | 720° C. |
| | wet drawing | diameter before drawing | 1.19 mm | 1.19 mm | 1.19 mm | 1.19 mm | 1.19 mm |
| | | diameter after drawing | 0.18 mm | 0.20 mm | (0.18 mm) | 0.18 mm | 0.18 mm |

In Table 2, Examples 1 and 2 are examples of producing the titanium fiber according to the invention according to preferable production conditions, wherein the thickness of the covering layer for the covered filament 3 in Example 2 is set to be thicker than that in Example 1. Moreover, in order that the equivalent area diameter of the titanium fiber to be produced in Example 2 is made equal to that in Example 1, the diameter of the composite filament 7 is made somewhat larger than that in Example 1.

Comparative example 1 is an example that the maximum arrival temperature of the composite wire 6 in the heat treatment is set to be lower than the range defined in the invention. On the other hand, Comparative example 2 is an example that the maximum arrival temperature of the composite wire 6 in the heat treatment is set to be higher than the range defined in the invention. Comparative Example 3 is an example of using copper as the covering layer 2. Moreover, since copper hardly diffuses into titanium as compared with iron, the maximum arrival temperature in Comparative example 3 is set to be higher than those of the other examples for preceding the softening degree of titanium in the heat treatment.

In the formation of the covering layer 2, an electroseamed pipe having a diameter of about 6 mm is formed from a strip for the formation of the covering layer 2, during which a pure titanium core wire 1 is inserted into the inside of the pipe and then subjected to drawing to a diameter of 4.3 mm, whereby an inner wall of the pipe is closed to the surface of the core wire. As the steel strip for the formation of the covering layer 2, a strip of SPCC steel is used in Examples 1 and 2 and Comparative examples 1 and 2, and a copper strip is used in Comparative example 3. In the formation of the composite wire 6, an electroseamed pipe having a diameter of about 6 mm is formed from a strip of SPCC steel, during which a bundle of the covered filaments 4 is inserted into the inside of the pipe and subjected to drawing to a diameter of 4.3 mm.

The heat treatment is carried out by continuously passing the composite wire through an electric furnace set to a given temperature in a weak-oxidizing atmosphere except that the heat treating atmosphere of the covered filament 3 in Comparative Example 3 is an inert atmosphere. The heat treated composite wire is subjected to pickling and washing with water to clean the surface thereof and then subjected to drawing. The drawing is carried out through a dry or wet cold drawing by using a lubricant for steel wire.

As a result of producing the composite filament 7 including many titanium fibers 8 under five production conditions shown in Table 2, the wire breaking in the final wet drawing step is frequently caused in Comparative Example 1 because the heat treating temperature of the composite wire 6 is set to a considerably low value and hence the composite filament 7 having a given diameter can not be obtained, while the composite filament 7 having a given diameter can be obtained in the other examples.

On the other hand, $\epsilon_T$ is 6.14 in Example 2 and 6.35 in the other examples, which can conduct the drawing and removal of covering layer and outer housing without problem to provide titanium fiber having a specific surface area according to the invention.

Now, the production of the bundle of titanium fibers 8 is attempted by subjecting the composite filament 7 produced in the examples other than Comparative Example 1 to a treatment of removing the covering layer and the outer housing, during which the yield at the removal step and properties of the resulting titanium fiber 8 are measured to obtain results shown in Table 3. Moreover, the removing treatment is carried out by selectively electrolyzing portions of the composite filament 7 corresponding to the outer housing 5 and the covering layer 2 in an electrolyte containing sulfuric acid.

The yield at the removal step means a ratio capable of separating titanium drawn wires from the composite filament 7 as a titanium fiber 8 when the electrolysis time in the removal step is 1 hour at maximum. And also, the specific surface area of the titanium fiber 8 is evaluated by measuring nitrogen adsorbing amount according to BET method and converting it into a surface area per unit amount.

TABLE 3

| Items | Example 1 | Example 2 | Comparative Example 2 | Comparative Example 3 |
|---|---|---|---|---|
| Yield in removal step of covering layer and outer housing | 100% | 100% | 7% | 100% |
| Equivalent area diameter of fiber | about 8 μm | about 8 μm | about 8 μm | about 8 μm |
| Specific surface area | 4.6 | 5.7 | — | 2.8 |

As shown in Table 3, the composite filament 7 in Comparative example 2 in which the heat treating temperature of the composite wire 6 is set to be extremely high can not completely be separated even when the electrolysis time at the removal step is 1 hour and hence the yield is considerably low. On the contrary, the composite filament 7 in Examples 1 and 2 can completely be separated in the electrolysis of less than 1 hour. The resulting titanium fiber 8 has a sectional shape as shown in FIG. 2 and forms many irregularities on the surface thereof. And also, it has a large specific surface area satisfying the relation of $A \geqq 25/d$ and can absorb a greater amount of nitrogen gas per unit weight. Furthermore, Example 2 can provide titanium fiber having a specific surface area larger than that of Example 1 because the thickness of the covering layer 2 is made thicker than that of Example 1.

On the other hand, in Comparative example 3 using copper as the covering layer, the composite filament 7 can completely be separated, but the surface of the resulting titanium fiber 8 is smooth as compared with the surface of the titanium fiber 8 made from the composite filament 7 in Examples 1 and 2. And also, the specific surface area is smaller than those of Examples 1 and 2 and does not satisfy the relation of $A \geqq 25/d$.

As mentioned above, the titanium fiber according to the invention has a specific surface area larger than that of the conventional titanium fiber obtained by the bundle drawing method. Therefore, when the titanium fiber according to the invention is used as a material for catalyst, catalyst carrier, gas adsorbent or the like, the weight is light and the performance is high as compared with the conventional ones. Furthermore, titanium fibers having a large specific surface area can stably be produced in a high yield by the production method of the invention.

What is claimed is:

1. A metal fiber comprising titanium or titanium alloy and having an equivalent area diameter d of 5–30 μm and a specific surface area A ($m^2/g$) satisfying $A \geqq 25/d$, wherein said metal fiber comprising titanium or titanium alloy has many fine irregularities on its surface, said metal fiber produced by a bundle-drawing method comprising the steps of:

covering a bundle of covered filaments, each of said covered filaments consisting of a core wire made of titanium or titanium alloy and a covering layer formed around the core wire, with an outer housing to form a composite wire;

subjecting the composite wire to repetition of cold drawing and heat treatment to form a composite filament; and removing the portions of the composite filament corresponding to the covering layer and the outer housing to obtain a bundle of metal fibers made of titanium or titanium alloy;

wherein the material of each of the covering layer and the outer housing is a mild steel containing not more than 0.25%/ by weight of carbon, and wherein the maximum temperature of the composite wire reached in the heat treatment is within a range of 580–650° C.

2. A metal fiber according to claim 1, wherein the specific surface area satisfies $30/d \leqq A \leqq 50/d$.

3. A metal fiber according to claim 1, wherein the covered filament is produced by forming the covering layer around the core wire to form a covered wire and subjecting the covered wire to heat treatment and cold drawing at least one time, in which maximum temperature of the covered wire reached in the heat treatment is within a range of 580–650° C.

4. A metal fiber according to claim 1, wherein a thickness of the covering layer in the covered filament is 5–20% of a diameter of the covered filament.

5. A metal fiber according to claim 1, wherein total amount of the cold drawing applied to the composite wire defined by $\epsilon_T, = 2 \times \ln(D_S/D_F)$ is within a range of 5.5–5.7, wherein $D_S$ is a diameter of the composite wire before the cold drawing and $D_F$ is a diameter of the composite filament.

* * * * *